US007971752B2

(12) United States Patent
Truxes

(10) Patent No.: US 7,971,752 B2
(45) Date of Patent: Jul. 5, 2011

(54) CINCH FOR RESILIENT COLLAPSIBLE TUBES

(76) Inventor: William W. Truxes, Park City, UT (US)

( * ) Notice: Subject to any disclaimer, the term of this patent is extended or adjusted under 35 U.S.C. 154(b) by 557 days.

(21) Appl. No.: 11/991,660

(22) PCT Filed: Sep. 9, 2006

(86) PCT No.: PCT/US2006/034823

§ 371 (c)(1),
(2), (4) Date: Mar. 7, 2008

(87) PCT Pub. No.: WO2007/030597

PCT Pub. Date: Mar. 15, 2007

(65) Prior Publication Data

US 2009/0127286 A1 May 21, 2009

Related U.S. Application Data

(60) Provisional application No. 60/715,932, filed on Sep. 9, 2005.

(51) Int. Cl.
*B65D 35/00* (2006.01)

(52) U.S. Cl. ..... 222/92; 222/95

(58) Field of Classification Search ..... 222/92–105
See application file for complete search history.

(56) References Cited

U.S. PATENT DOCUMENTS

| | | | | |
|---|---|---|---|---|
| 4,027,985 | A * | 6/1977 | Loesser, III | 401/134 |
| 5,344,049 | A * | 9/1994 | MacDonald | 222/107 |
| 6,415,479 | B1 * | 7/2002 | Steinberg | 24/30.5 R |
| 6,419,115 | B1 * | 7/2002 | Logan, Jr. | 222/1 |
| 6,561,385 | B1 * | 5/2003 | Jacobs | 222/99 |
| 6,685,057 | B1 * | 2/2004 | Sullivan | 222/99 |
| 6,746,699 | B2 * | 6/2004 | Lohrey et al. | 426/83 |
| 2001/0040172 | A1 * | 11/2001 | Pirrallo | 222/99 |

* cited by examiner

*Primary Examiner* — Lien T Ngo

(57) ABSTRACT

A cinch (10) to hold resilient tubes (22), permanently collapsed, during and between use. Partially used resilient tubes (22) can not stay collapsed without an external containment, like a cinch (10), made of a single piece of back-to-back, self-engaging material. As product is dispensed, the tube is flattened (24) to keep product at the outlet (30) and folded to form a passageway (26) wide enough to receive the cinch (10) that was stored on the tube (100). A cinch (10) inserted through the passageway (26), wrapped around the body of the tube (28), overlapped and fastened (18) to itself, will permanently hold the tube (22) in a collapsed state, ready to use and full to exclude the atmosphere protecting its contents from contamination, oxidation and drying, over the products useful life time. A tube (22) so contained may be stored in new ways. The string (11) and holes (16) allow for aftermarket decoration, identification and tracking of product.

3 Claims, 1 Drawing Sheet

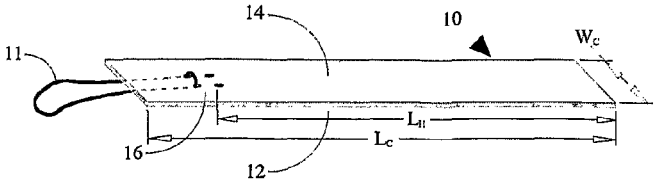
*Fig. 1*
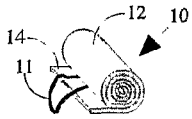
*Fig. 2*
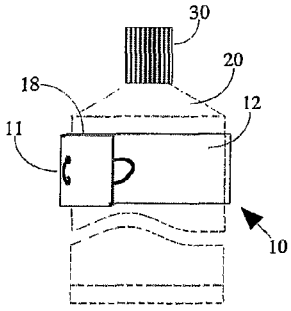
*Fig. 3*
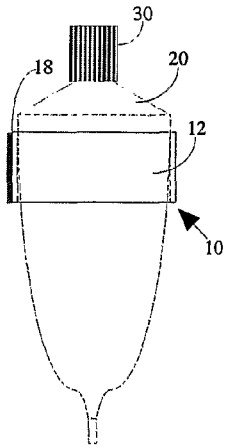
*Fig. 4*
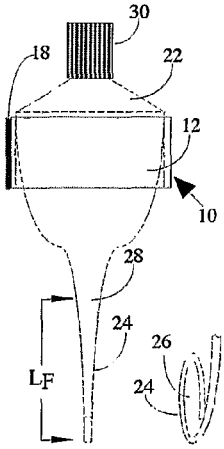
*Fig. 5*
*Fig. 6*
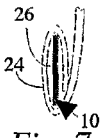
*Fig. 7*
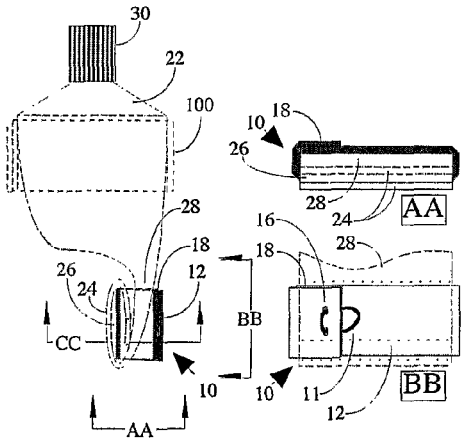
*Fig. 8*
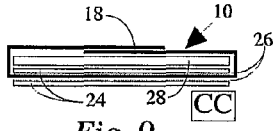
*Fig. 9*
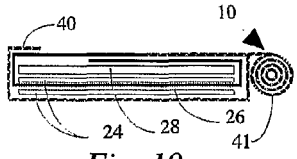
*Fig. 10*
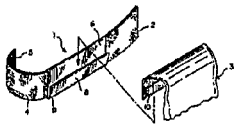
*Fig. 11*
*~1994 Prior Art~*
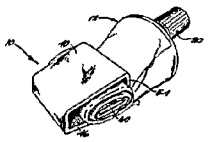
*Fig. 12*
*~1995 Prior Art~*
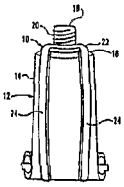
*Fig.13*
*~1995 Prior Art~*
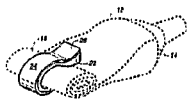
*Fig. 14*
*~2002 Prior Art~*
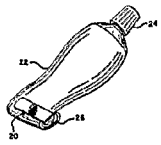
*Fig. 15*
*~2004 Prior Art~*

CINCH FOR RESILIENT COLLAPSIBLE TUBES

CROSS-REFERENCE TO RELATED APPLICATIONS

This application claims the benefit of provisional patent application Ser. No. 60/715,932, filed 2005 Sep. 9 by the present inventor.

FEDERALLY SPONSORED RESEARCH

Not Applicable.

REFERENCE TO A MICROFICHE APPENDIX

Not Applicable.

SEQUENCE LISTING

Not Applicable.

TECHNICAL FIELD OF THE INVENTION

This invention relates in general to devices used to give resilient collapsible dispensing containers or squeeze tubes, nonresilience, and in particular to a novel cinch to hold or retain a resilient squeeze tube in a collapsed state, emulating nonresilience.

BACKGROUND ART

Originally a nonresilient collapsible squeeze tube, U.S. Pat. No. 2,252 to Rand (1841), "permanently collapsed" under pressure, to reduce container volume to match remaining product volume or as Rand said " . . . the remaining capacity being at all times full, . . . ", keeping the product close to the discharge outlet and preventing or reducing suckback, excluding the atmosphere during use, to prevent drying, oxidation or contamination of the product over its life time and possibly eliminating or reducing a requirement for preservatives. This collapsing volume also maintains the portion of product discharged from the tube relative to pressure applied almost constant from a full to nearly empty.

Rands patent taught proper use of his tube, that had less than perfect nonresilient characteristics, by instructing users to squeeze from the bottom "end d." . . . "and when collapsed the end d may be rolled up". His roll up, mechanically augmented the nonresilience to maintain the fullness of the tube.

Increased use of resilient plastics in fabrication of collapsible squeeze tubes, since 1953, has made this problem of not remaining "permanently collapsed", even more pronounced. Besides having an adverse effect on some products, the air that gets sucked back into resilient tubes creates space for the product to settle, perhaps, away from the discharge outlet, requiring addition squeezing to bring the tube to a full condition, i.e. expel the air, and then dispense the product. To get around this extra squeezing, users shake the product down to the outlet or store the resilient container outlet down. Having product ready at the discharge outlet can be another problem for resilient containers which are also subject to over pressure, caused by change in air pressure or too firm a grip, which may cause leaking, afterflow or squirting on opening.

Prior art solutions have been variations of Rands "rolled up" approach, either attachable rigid or elastic mechanical devices that just hold it after hand rolling, like U.S. Pat. No. 5,373,968 to Nelson (1994), see FIG. 11, U.S. Pat. No. 5,442, 839 to Miller (1995), see FIG. 12, U.S. Pat. No. 5,467,897 to Williams (1995), see FIG. 13, U.S. Pat. No. 6,393,675 to Gaetke (2002) see FIG. 14, U.S. Pat. No. 6,749,087 to Robinson (2004), see FIG. 15, or that act on the walls to "roll up" the container and then hold it. Most tube users do not need assistance with collapsing and folding or rolling, just holding it in a collapsed state while not being used.

All prior art devices, rigid or not, are designed to work only with certain size tubes and will not work with most of the industry estimated 32+ billion tubes sold in 2005 world wide into eleven markets: Art; Automotive; Construction; Cosmetic; Dentifrice; Food; Household; Industrial; Medical; Pharmaceutical and Skin Care. They may not be resized for use on out of range smaller circumference tubes or combined for use on out of range larger circumference tubes.

Absent from the art is an attachable squeeze tube holder, unencumbered by awkward rigid or fatigable elastic components of fixed size, which is simple, adjustable, highly useful, easily transportable, economical and convenient to make, use and reuse, that can keep a tube "permanently collapsed" between uses.

DISCLOSURE OF INVENTION

Objects and Advantages

Accordingly, besides the objects and advantages of the invention described in my above patent, several new and unexpected objects and advantages of my present invention are:

to provide a retainer without rigid components, so that it is easier and more economical to fabricate and use;

to provide a retainer without rigid components, so that it may be rolled onto itself forming a compact cylinder which is easier and more economical to bulk package, ship and store in boxes, bags or jars, independent of a product tube;

to provide a retainer without rigid components, so that it may be wrapped and fastened onto the full tube of product it will be used with, for easier and more economical dedicated or combined packaging and shipping;

to provide a retainer without rigid components, so that it is resizable to fit smaller tubes by further overlapping onto the tube or rolling onto itself or trimming with household scissors;

to provide a retainer without rigid components, so that it is resizable to fit larger tubes by combining two or more overlapped cinches;

to provide a retainer that is reusable;

to provide a gripping surface on the tube;

to provide a fold in a tube that is strong enough such that the tube may be hung by it.

Further objects and advantages of my invention will become apparent from a consideration of the drawings and ensuing description.

BRIEF SUMMARY OF THE INVENTION

In accordance with the present invention a retainer to keep resilient squeeze tubes "permanently collapsed" comprises a strap of flexible, pliable, reusable, back-to-back self-engaging material having a feature for decorating, identifying or hanging the tube.

BRIEF DESCRIPTION OF THE DRAWINGS

It to be understood that the components shown in the following figures are not necessarily to scale, with emphasis instead being placed upon illustrating the principles of the cinch.

FIG. 1 is a perspective view of a cinch strap, according to the invention;

FIG. 2 shows the cinch strap stored, rolled onto itself;

FIG. 3 shows the cinch strap stored, wrapped onto a tube—front view;

FIG. 4 shows the cinch strap stored, wrapped onto a full tube—side view;

FIG. 5 shows the cinch strap stored, wrapped onto a partial tube—side view;

FIG. 6 shows the flat end of a tube folded a minimum of two times to form a cinch strap passageway—side view;

FIG. 7 shows the flat end of a tube folded a minimum of two times with a cinch strap in the passageway—side view;

FIG. 8 shows a cinch strap in use—side view; bottom view AA and front view BB.

FIG. 9 shows a schematic view of FIG. 8 cross section CC—use of proper length cinch strap.

FIG. 10 shows a schematic view of FIG. 8 cross section CC—use of longer than required cinch strap.

FIG. 11 shows 1994 prior art, [U.S. Pat. No. 5,373,968] velcro with "metallic member".

FIG. 12 shows 1995 prior art, [U.S. Pat. No. 5,442,839] plastic/metal/ceramic over roll clip FIG. 13 shows 1995 prior art, [U.S. Pat. No. 5,467,897] elastic retainer, over tube.

FIG. 14 shows 2002 prior art, [U.S. Pat. No. 6,393,675] metal on foam, over roll clip.

FIG. 15 shows 2004 prior art, [U.S. Pat. No. 6,749,087] metal thru fold passageway roll clip.

REFERENCE NUMERALS IN DRAWINGS

10 cinch
11 string
12 outside surface, harder fastener material—hooks, mushrooms.
14 inside surface, softer fastener material—loops.
16 holes for decoration, string pull, or tag (print, bar code or RFID).
18 overlapped and engaged back-to-back material
20 full tube of product
22 partially used tube
24 flat area of tube devoid of product
26 passage way formed by folded flat area 24
28 body of tube between full and empty volume of tube
30 screw on or flip cap or nozzle or discharge outlet of tube
40 long cinch, wrapped at least one and a half times normal.
41 long, cinch, not long enough for wrapping twice may be roll stored.
100 cinch removed from storage site on full tube

DETAILED DESCRIPTION OF A PREFERRED EMBODIMENT

In the following discussion of the drawings it is noted that while the descriptions are cast primarily in general terms of squeeze tubes, the invention may conform to and be used in conjunction with any number of different resilient collapsible dispensing containers well known in the art, that are undesirably resilient for the application. Hereinafter, the terms cinch, strap, cinch strap, holder or retainer, all shall refer to the invention constructed from any present and future, commercially available, flexible, pliable, reusable (i.e. high engage/disengage duty cycle), back-to-back self-engaging strap material, that on overlapping the inside onto the outside of a wrap, fastens with reasonable holding force for the task at hand, such as Velcro™ brand OneWrap™, Velcro™ brand OmniWrap™, Aplix® back-to-back, 3M Scotch® 100 Cable & Wire Tie Wrap, etc.

FIG. 1 illustrates the preferred embodiment of a cinch strap 10, according to the invention, consists of a length, L.sub.C, of self-engaging strap material, cut to wrap around the tube and overlap by 25%, equal to one and one quarter of the circumference or about four times the diameter of the tube it is to be used on. (For example the 2.4 billion toothpaste tubes used per year in the USA tend to be 1.5" in diameter, therefore L.sub.C=6".) W.sub.C is selected from the industry standard widths, well known in the art to have sufficient shear strength for the task at hand. Having an outside surface 12 and an inside surface 14 that are self-engaging. If holes 16 are required, at least two are formed thermally or by die cut, at a distance L.sub.H from either end, for use as a non interfering attachment feature for decoration, string 11 pull, hanging of tags, such as printed tags, barcode tags or RFID tags. Holes 16 will not be required if the cinch strap 10 is directly marked or if the decoration, string 11 pull or tag are sewn or glued on. The string pulls 11 shall be of any type or material available to the trade of thickness as to not to interfere with rolling or wrapping.

Operation—FIGS. 2 to 10

FIG. 2 illustrates the preferred embodiment of the cinch for bulk packaging and shipping in bags or jars, were a cinch strap 10, is rolled onto itself, the outside surface 12 onto the inside surface 14, until it forms a tight cylindrical package. This configuration protects the softer inside 14 (loops) from snagging and clumping. The string 11 shall be free to be pulled to either side of the strap 10, so that on rolling or wrapping, it may be pulled to be within the overlap between the engaging surfaces. Allowing the string 11 to protrude from the overlap, facilitates the peeling apart of the engaged surfaces.

FIG. 3 illustrates the preferred embodiment of the cinch 10, wrapped around and fastened at the overlap 18, for dedicated packaging and shipping on the full tube 20 (front view) of product it will be used with. The string 11 is shown in position to aid peeling open the overlap 18 however it may protrude up or down for decorations, tags or hanging. The softer inside 14 is shown against the full tube 20 to protect its surface, while the rougher outside 12 provides an improved gripping surface.

FIG. 4 illustrates the same full tube 20 with the cinch 10 attached from a side view. A cinch strap 10 should be on every resilient tube 20 just like a cap 30 is.

FIG. 5 illustrates a partially used tube 22, indicated by the collapsed or flat area 24 from a side view, with cinch 10 still stored on it. Tubes have the same circumference top to bottom, either full 20 or flat 22. When the flat area 24 length L.sub.F equals a little more than twice the width W.sub.C of the cinch 10, the tube 22 may be folded twice.

FIG. 6 illustrates the collapsed flat area 24 folded twice forming a passageway 26 for the cinch 10 to be inserted through.

FIG. 7 illustrates the collapsed flat area 24 folded twice with the cinch 10 inserted through the passageway 26. Centering the cinch 10 in the passageway 26 leaves three quarters of the cinch 10 length L.sub.C hanging out of each end of the folded collapsed area 24. This is sufficient for an overlap 18 of one quarter to one half the circumference of the tube 22. Note the circumference is the same full or flat.

FIG. 8 shows that the cinch 10 is in use and no longer at the storage site 100 on the top of the tube 22. Having been removed by peeling back the overlap 18 shown in FIGS. 3, 4 and 5 and inserting it through the passageway 26 as shown in FIG. 7. The cinch 10 is now shown to be wrapped around one flat area fold 24 and the body 28, and overlapped 18 on the body side, thus securing the folds 24 to the body 28. View AA of FIG. 8 shows this from the bottom of the tube and view BB shows the overlap 18 on the lower body 28 of the tube partially collapsed tube 22.

FIG. 9 is a schematic of the FIG. 8 cross section CC, illustrating how to use a strap 10 of proper length. Proper length, L.sub.C, equal to one and one quarter of the circumference or about four times the diameter of the tube 22 it is to be used on. Thread the strap 10 through the passageway 26 formed by the folds 24, center the strap 10 therein, wrap these ends around the body 28 of the tube 22, overlap 18 to engage.

FIG. 10 is a schematic of the FIG. 8 cross section CC, illustrating how to use a strap 10 of greater then proper length for the tube. When the strap 10 is greater than 50% longer than required, it may be wrapped on around and overlapped on top of itself 40, or when less than 50% greater in length and can not reach itself to overlap, it may be rolled on itself 41, at the edge for storage. In either case, you could trim the strap 10 to proper length with scissors. If the strap 10 is shorter than L.sub.C, two or more may be combined or overlapped to achieve the desired length.

CONCLUSION, RAMIFICATION, AND SCOPE OF THE INVENTION

Accordingly, the reader will see that the cinch of this invention provides, what has been absent from the art, an attachable, improved, nonrigid, simple, adjustable, highly useful, easily shipped and stored, economical and convenient to make, use and reuse, cinch or cinch strap retainer to keep all sizes of resilient collapsible squeeze tubes "permanently collapsed" between uses. A cinch which may be either uniquely rolled upon itself for storage and shipping, separate from a tube, or wrapped, overlapped, and fastened around a full tube, for storage and shipping with that tube. Tubes retained with this invention may be hung by the folds or balanced on a ordinary cap, i.e. stored in new ways.

While my above description contains many specificities, these should not be construed as limitations on the scope of the invention, but rather as an exemplification of preferred embodiments thereof. Many other variations are possible.

Accordingly, the scope of the invention should be determined not by the embodiments illustrated, but by the appended claims and their legal equivalents

I claim:

1. A cinch strap for holding and folding a permanently collapsed and folded portion of a resilient collapsible dispensing container or squeeze tube to body of the tube, the strap comprising:

a. a single piece of flexible, reusable, back-to-back self-engaging material having a length equal to four times the diameter of said squeeze tube;

b. an outside surface and an inside surface that are engageable and disengageable for use, reuse and adjustability;

c. a non interfering attachment of at least one pair of holes sized and positioned to pass a string through, said string to being used as a disengagement assist, a hanger, an attachment for a decoration or a tag for identification of the content or ownership of the tube.

2. The cinch strap of claim 1 when not in use, stores flat, rolled onto itself or wrapped on the full tube it will be used on.

3. The cinch strap of claim 1, can attach thereon a tag for identification of content or ownership of the tube, said tag can be any variety of tag, including, but not limited to a printed message, a printed barcode, a magnetic code, a holographic code or a RFID.

* * * * *